US005149361A

United States Patent [19]

Iyori et al.

[11] Patent Number: 5,149,361

[45] Date of Patent: Sep. 22, 1992

[54] CERMET ALLOY

[75] Inventors: Yusuke Iyori, Fukaya; Nobuhiko Shima, Narita, both of Japan

[73] Assignees: Hitachi, Ltd., Chiyoda; Hitachi Taga Engineering Co., Ltd., Koto, both of Japan

[21] Appl. No.: 457,172

[22] Filed: Dec. 26, 1989

[30] Foreign Application Priority Data

Dec. 27, 1988 [JP] Japan ..... 63-330570

[51] Int. Cl.[5] ..... C22C 29/12; C22C 29/02; C22C 29/06; C22C 29/14

[52] U.S. Cl. ..... 75/233; 75/234; 75/235; 75/236; 75/237; 75/238; 75/244

[58] Field of Search ..... 75/232, 234, 235, 236, 75/237, 238, 239, 240, 241, 233, 244

[56] References Cited

U.S. PATENT DOCUMENTS

| | | | |
|---|---|---|---|
| 4,171,973 | 10/1979 | Hara et al. | 75/237 |
| 4,623,388 | 11/1986 | Jatkar et al. | 75/232 |
| 4,828,611 | 5/1989 | Nakai et al. | 75/237 |
| 4,957,548 | 9/1990 | Shima et al. | 75/238 |
| 4,985,070 | 1/1991 | Kitamura et al. | 75/238 |

FOREIGN PATENT DOCUMENTS 0181979 5/1986 European Pat. Off. .

OTHER PUBLICATIONS

Patent Abstracts of Japan, vol. 11, No. 24; J61199048.
Patent Abstracts of Japan, vol. 11, No. 47; J61210150.
Patent Abstracts of Japan, vol, 12, No. 297; J6365050.
Patent Abstracts of Japan, vol. 12, No. 353; J63109139.
Patent Abstracts of Japan, vol. 10, No. 239; J6173857.

*Primary Examiner*—Brooks H. Hunt
*Assistant Examiner*—Daniel J. Jenkins
*Attorney, Agent, or Firm*—Antonelli, Terry, Stout & Kraus

[57] ABSTRACT

A cermet alloy having a structure including a hard phase and a bonding phase which is composed of at least one ferrous metal, said bonding phase containing fine hard grains of a mean grain size not greater than 2000 Å dispersed therein. The structure has a composition consisting of 10 to 70 wt % of TiCN, 5 to 30 wt % of WC, 5 to 30 wt % of NbC, 1 to 10 wt % of $Mo_2C$, 0.5 to 5 wt% of VC, 0.05 to 3 wt % of ZrC, 5 to 25 wt % of (Ni, Co), and not smaller than 2.5 wt% of total nitrogen and incidental impurities.

3 Claims, 4 Drawing Sheets

1000 Å

CERMET ALLOY

BACKGROUND OF THE INVENTION

The present invention relates to a cermet alloy which is superior in resistance to high temperature wear, high temperature strength and chipping resistance.

In general, a known cermet alloy contains hard titanium carbide (expressed as "TiC" hereinafter) as the main constituent, and a component such as molybdenum carbide, tungsten carbide, tantalum carbide or niobium carbide (respectively expressed as "$Mo_2C$, WC, TaC and NbC" hereinafter) which is added in order to improve wettability between a bonding phase which is composed of a metal and TiC grains or grains of titanium carbo-nitride (expressed as "TiCN" hereinafter) which are hard grains similar to the TiC grains. Such an additive component is dissolved into the bonding phase and precipitates around the TiC or TiCN grains during sintering at high temperature, so as to envelope the TiC and TiCN grains thereby forming a surrounding structure, thus contributing to improvement in the wettability to the bonding phase. In the known cermet alloy, therefore, the composite carbo-nitride of the type mentioned above has a double core structure, wherein the core structure is rich in titanium (expressed as "Ti" hereinafter) while the surrounding structure is rich in $Mo_2C$, WC, TaC or NbC which improves the wettability between the hard grains and the bonding phase which is not rich in Ti. Such a cermet alloy is disclosed, for example, in Japanese Patent Publication No. 56-51201 and Japanese Patent Laid-Open Publication Nos. 61-73857, 61-201750 and 61-210150.

FIG. 7 is a scanning electron microscopic photograph of the micro structure of this known cermet alloy. It will be seen from this Figure that the core structure of the double core structure of the composite carbo-nitride is dark thus suggesting that this core structure is rich in Ti which is a light element, while the surrounding structure is bright thus suggesting that this portion is rich in heavy elements such as tungsten (expressed as "W"), tantalum (expressed as "Ta") and so forth.

On the other hand, an analysis of the composite carbo-nitride in the double core structure through a transmission analyzing electron microscope showed that the core structure contains 65.8% of Ti and 5.0% of W while the surrounding structure contains 49.5 wt % of Ti and 23.2 wt % of W. Thus, the core structure is rich in Ti and poor in W, while the surrounding structure is rich in W and poor in Ti as compared with the core structure.

When the known cermet alloy having the above-described micro structure is used as a material of a cutting tool for high-speed cutting, the binding phase having a comparatively small hardness is worn so that the composite carbo-nitride grains appear on the surface of the tool. However, the surrounding structure of the double core structure, which is rich in W and poor in Ti, exhibits a large oxidation tendency and low hardness, to thereby be worn rapidly. In consequence, it is impossible to fully utilize the advantage offered by the Ti as the hard component. In addition, the surrounding structure is constituted by components such as $Mo_2C$, WC, TaC and NbC which are intended for improving wettability to the bonding phase, so that the composite carbo-nitride grains grow during the sintering with the result that the grown grains are in contact with each other. Obviously, the bonding strength is small in the regions where the composite carbo-nitride grains contact each other so that fine cracks tend to appear at these regions when an external stress is applied In addition, these regions tend to cleave as paths of propagation of the cracks. In consequence, the fracture toughness value of the cermet alloy is reduced and chipping resistance is also impaired as the number of regions of mutual contact of grains becomes greater. These problems would be overcome by reducing the contents of the components constituting the surrounding structure. In such a case, however, the high temperature strength of the cermet alloy is seriously degraded. Therefore, it is necessary to maintain a considerably large content of the components constituting the surrounding structure. In consequence, the cermet alloy inevitably has a considerably large number of regions where the composite carbo-nitride grains contact one another.

In order to overcome the above-described problems, it has been proposed to disperse a pseudo-TiC phase which is rich in TiC besides the composite carbo-nitride phase, so as to improve the wear resistance, as disclosed in Japanese Patent Laid-Open Publication No. 61-199048.

Also it has been proposed to form an alloy in which the hard phase has a two-phase structure composed of both an NaCl-type solid solution phase with a core and titanium nitride (expressed as "TiN") and in which fine grains having a composition of $Ni_3Al(Ti)$ composition is precipitated and dispersed in the bonding phase, as disclosed in Japanese Patent Laid-Open Publication No. 63-39649.

The known cermet alloy of the type described is still unsatisfactory in that the wear resistance is not so high, although the proposal in Japanese Patent Laid-Open Publication No. 61-199048 offers an appreciable improvement in the wear resistance. In this improved cermet alloy, however, the composite carbo-nitride grains other than the pseudo-TiC phase still have surrounding structure similar to that in the conventional cermet alloys In addition, the composite carbo-nitride grains other than the pseudo-TiC phase occupies most portion of the hard phase. Therefore, when the hard phase has appeared on the tool surface after wear of the bonding phase which has a comparatively small hardness, no substantial improvement is achieved in the wear resistance insofar as the the composite carbo-nitride grains other than the pseudo-TiC phase have surfaces rich in W and poor in Ti as in the case of the conventional cermet alloys. Furthermore, the addition of the pseudo-TiC phase cannot significantly increase the wear resistance considering that this phase occupies only 20 vol % or so of the whole hard phase, though this phase exhibits a comparatively high hardness.

The proposal made in Japanese Patent Laid-Open Publication No. 63-39649 encounters a problem substantially the same as that explained in connection with Japanese Patent Laid-Open Publication No. 61-199048. It is true that the cermet alloy disclosed in Japanese Patent Laid-Open Publication No. 63-39649 has a comparatively large TiN content. The TiN, however, is partly dispersed in a NaCl type solid solution and partly exists as independent TiN phase. The independent TiN phase occupies only a small part of the hard phase and, therefore, is expected to produce only a small effect on the improvement in wear resistance. It is stated that the strength of the bonding phase is improved by allowing dispersed precipitation of fine grains having a composition of $Ni_3Al(Ti)$. The dispersion of the fine grains in the bonding phase is effected by allowing precipitation in the course of the sintering, while the bonding phase is composed of nickel and aluminum (expressed as "Ni" and "Al", respectively) or Ni and cobalt (expressed as "Co"). It is therefore extremely difficult to control mean grain size, precipition amount and other factors, as well as the trace amount of Al to be added.

SUMMARY OF THE INVENTION

Accordingly, an object of the present invention is to provide a cermet alloy in which the hardness and wear resistance of a surrounding structure of the hard phase, as well as the strength of the bonding phase, are improved while the mutual contact of hard phase grains is remarkably reduced to improve chipping resistance, thereby overcoming the above-described problems of the prior art.

To this end, according to the present invention, there is provided a cermet alloy having a hard phase and a bonding phase containing at least one kind selected from the metals of iron group of periodic table wherein the bonding phase has a structure in which fine hard grains of a mean grain size not greater than 2000 Å are dispersed. Mean grain sizes exceeding 2000 Å are not recommended because such coarse grains cannot provide so-called dispersion-strengthened function.

Preferably, the fine hard grains exhibit a single layer structure. The term "single layer structure" is used to mean a structure excluding the core structure or the double core structure employed in conventional cermet alloys, although presence of incidental impurities in the structure is permissible.

The material of the fine grains may be one, two or more selected from a group consisting of TiCN, zirconium carbide (expressed as "ZrCN"), hafnium carbide (expressed as "HfC"), alumina (expressed as "$Al_2O_3$"). yttria (expressed as "$Y_2O_3$"), dysprosium oxide (expressed as "$Dy_3O_2$"), zirconia (expressed as "$ZrO_2$") and neodymium oxide (expressed as "$Nd_3O_2$").

The hard phase may be carbides, nitrides or carbonitrides of two or more elements selected from elements of groups IVb, Vb and VIb, or a mixture of such carbides, nitrides and carbo-nitrides.

Preferably, the hard phase has a double core structure composed of a core structure which is comparatively poor in Ti and rich in W and a surrounding structure which is comparative rich in Ti and poor in W.

It is also preferred that another hard phase having a mean grain size not smaller than 1 μm and having a single layer structure, composed of a carbide, nitride or carbo-nitride which contains Ti, or their mixture, is in an amount of 0.5 to 40 vol % to the total hard phase.

Such additional hard phase exhibits a hardness greater than that composed of two or more elements of IVa, Va and VIa groups, so as to contribute to the improvement in the wear resistance. In order to obtain such an advantageous result, it is necessary that the content of such additional hard phase has to be 0.5 vol % or greater to the total hard phase. This additional hard phase, however, exhibits only a small wettability to the bonding phase so that the bonding strength of the hard phase to the bonding phase is reduced to impair the toughness of the cermet alloy when the content of the additional hard phase exceeds 40 vol %. Mean grain size of the additional hard phase less than 1 μm is not preferred because such small grain size reduces the toughness.

The content of carbon (expressed as "C") in the whole composition is preferably determined to be greater than the lower limit of the sound phase range and ½ or less, preferably ¼ or less of the sound phase range. The term "sound phase range" is used to mean the range of the carbon content between an upper limit where free C starts to precipitate and a lower limit where decarburized layer starts to appear. The lattice constant of the bonding phase is substantially in inverse proportion to the C content within the sound phase range. Namely, the smaller the C content, the greater the lattice constant. Thus, smaller C content is preferred because it increases content of solid solution of heat-resistant metallic elements such as W, Mo or the like in the bonding phase, so that the bonding phase is solid-solution-strengthened to exhibit a greater resistance to plastic deformation at high temperature. Therefore, the C content is determined to be ½ or less, preferably ¼ or less, of the sound phase range. Any C content below the lower limit of the sound phase range causes a substantial saturation of the lattice constant and, in addition, allows fragile decarburized layer such as $(CO_3W_3)C$, $M_{12}C$, $M_6C$ and so forth, resulting in a serious reduction of the toughness. When the carbon content is decreased, the contents of W, Mo and so forth in the form of solid solution in the bonding phase are increased, with the result that the coercive force of the cermet alloy of the invention is decreased. The level of the coercive force of the alloy of the present invention varies depending on the ratio of content between Co and Ni, the coercive force being generally not greater than 50 Oe in the case of C content existing in the sound phase range.

In the cermet alloy of the present invention, the ratio Ni/(Co+Ni) is preferably not smaller than 3/10.

The cermet alloy of the present invention preferably has a composition consisting of 10 to 70 wt % of TiCN, 5 to 30 wt % of WC, 5 to 30 wt % of NbC, 1 to 10 wt % of $Mo_2C$, 0.5 to 5 wt % of VC, 0.05 to 3 wt % of ZrC, 5 to 25 wt % of (Ni, Co), and not less than 2 5 wt % of total nitrogen and incidental impurities.

TiCN is added for the purpose of formation of fine grains which are to be dispersed in the hard phase of double core structure, in additional hard phase of single layer structure and in the bonding phase. TiCN content below 10 wt % makes it impossible to attain the desired high temperature wear resistance and high temperature strength, while TiCN content exceeding 70 wt % undesirably impairs the toughness of the alloy. For these reasons, the TiCN content is determined to be 10 to 70 wt %.

WC is a component which improves the high temperature strength. In order to attain an appreciable improvement in the high temperature strength, the WC content should be not less than 5 wt %. On the other hand, WC content exceeding 30 wt % reduces the wear resistance and, in addition, increases the amount of the surrounding structure of the hard phase to thereby impair the toughness. For these reasons, the WC content is determined to be 5 and 30 wt %.

NbC, which is a component effective in improving high temperature strength, cannot produce appreciable effect when its content is below 5 wt %, whereas, when the NbC content exceeds 30 wt %, the amount of the surrounding structure of the hard phase is increased to impair the toughness as in the case of WC.

TaC provides a greater effect than NbC in improving the toughness and, therefore, is more advantageous than NbC when used under a cutting condition of large mechanical impact Therefore, NbC may be partly or wholly substituted by TaC.

$Mo_2C$ is a component which improves the wettability between the hard phase of the double core structure and the bonding phase, while contributing to improvement in the toughness and reduction in the grain size. This component, however, cannot produce any appreciable effect when its content is below 1 wt %. Conversely, $Mo_2C$ content exceeding 10 wt % seriously impairs the wear resistance at high temperature because this component per se exhibits a low level of hardness. The $Mo_2C$ content, therefore, is determined to be 1 to 10 wt %.

VC, which is a component for improving the wear resistance, cannot produce any appreciable effect when its content is below 0.5 wt %. On the other hand, VC content exceeding 5 wt % reduces toughness. The VC content is therefore selected to be 0.5 to 5 wt %.

ZrC is effective in improving both high temperature strength and toughness, as are the cases of NbC and TaC. These effects, however, are not appreciable when the ZrC content is below 0.05 wt %. On the other hand, when ZrC content exceeds 3 wt %, wear resistance is significantly reduced. The ZrC content, therefore, is determined to be 0.05 to 3 wt %.

Ni and Co are components which form the bonding phase for bonding segments of the hard phase and, hence, are effective in improving the toughness of the cermet alloy. If the contents of these elements in total is below 5 wt %, it is impossible to obtain a desired level of toughness of the cermet alloy, whereas, when the contents of these elements in total exceed 25 wt %, the amount of the hard phase is relatively reduced to impair wear resistance of the cermet alloy. The contents of Ni and Co in total, therefore, are determined to be 5 to 25 wt %.

Nitrogen (expressed as "N") is effective in suppressing any excessive generation of the surrounding structure of the hard phase and increases the lattice constant of the bonding phase. Such effects, however, cannot be attained when the N content is small. The total N content, therefore, is determined to be not less than 2.5 wt %.

The alloy composition as specified above offers a remarkable improvement in the heat resisting property and plastic deformation-resisting property of the bonding phase. Namely, the fine grains of the mean grain size not greater than 2000 Å, which are stable even at high temperature and which are dispersed in the bonding phase, dispersion-strengthen the bonding phase and remarkably improve high-temperature creep strength of the same. W and other elements having high hardness naturally form solid solution in the bonding phase so that the bonding phase is strengthened by solid solution-strengthening function as in the case of the conventional alloys. Thus, in the cermet alloy of the present invention, the dispersion-strengthening effect produced by the dispersed fine grains is added to the above-mentioned solid solution-strengthening function, so that the bonding phase exhibits a remarkable improvement in the resistance to plastic deformation. During the sintering, corners of the fine hard grains are partially dissolved into the bonding phase so that the grains exhibit substantially spheroidized or ellipsoidal form so as to suppress inner notch effect in the bonding phase. This also contributes to the improvement in the resistance to plastic deformation.

The above-mentioned fine grains are partly taken into the surrounding structure of the hard phase but do not inherently have affinity to the surrounding structure. Therefore, the fine grains dispersed in the bonding phase are effective in preventing undesirable mutual contact and mutual bonding of hard phase segments. This in turn prevents occurrence of thermal cracks and remarkably improves the heat resistance.

The hard phase in the cermet alloy of the present invention has a double core structure composed of a core structure which is comparatively poor in Ti and rich in W and a surrounding structure which is comparatively rich in Ti and poor in W. This hard phase can be produced by, for example, adding powdered TiCN to the solid-solution material of composite carbo-nitride. TiCN is thermo-dynamically unstable at high temperature and is extremely unstable particularly when a source of C exits around TiCN. The external addition of TiCN, therefore, causes a thermal decomposition of TiCN and preferential solid-solutioning into the bonding phase. In consequence, the solid-solutioning of the surrounding structure formers contained in the composite carbo-nitrides, e.g., Mo, Ta, Nb and so forth, is suppressed. This is turn suppresses the degree of formation of the surrounding structure of the hard phase, thereby remarkably reducing the mutual contact of the hard phase segments, whereby the heat resistance or chipping resistance is improved.

A part of W and other hard components are partially solid-solutioned into the bonding phase also from the composite carbo-nitride during the sintering. However, since the composition of the composite carbo-nitride is comparatively similar to that of the surrounding structure, the above-mentioned hard components do not precipitate in TiCN but precipitate only on the surface of the composite carbo-nitride. Therefore, an increase in the amount of externally added TiCN causes independent TiCN grains to exist in the alloy structure or in the bonding phase. The presence of such hard TiCN grains is expected not only to increase the wear resistance but also to suppress progress of wear of the bonding phase.

In addition, Ti and N in the material powder are thermally decomposed so as to diffused and solid-solutioned in the hard phase which is composed of the composite carbo-nitride, so that the hard phase can have the aforementioned double core structure with a surrounding structure rich in Ti, i.e., a hard surface with high anti-oxidation property.

Wear of the tool material proceeds such that the bonding phase is worn first to allow the hard phase to appear on the tool surface. The surface of the hard phase rich in Ti provides one of the reasons of remarkable improvement in the wear resistance including anti-oxidation property. This effect is multiplied with the effect produced by the TiCN grains in the bonding phase, to attain a further improvement in the wear resistance.

When Ti and N solid-solutioned in the bonding phase as described are diffused and solid-solutioned into the hard phase composed of the composite carbo-nitride, W which is contained in the composite carbo-nitride and which exhibits small affinity to N is excluded from the hard phase so as to be diffused into the bonding phase. In consequence, the bonding phase is greatly strengthened to attain a remarkable improvement in high temperature strength.

The cermet alloy of the present invention can contain, besides the above-mentioned hard phase, 0.5 to 40 vol % of additional hard phase of single layer structure which is composed of a Ti-containing carbide, nitride, carbo-nitride or their mixture and which has a mean grain size not smaller than 1 μm. Such additional hard phase further improves wear resistance of the cermet alloy.

EXAMPLE 1

Commercially available powders were used as the material of the components of the hard phase. These powders were TiCN powder having a mean grain size of 1.4 μm, NbC powder having a mean grain size of 1.5 μm and $Mo_2C$ powder having a mean grain size of 1.2 μm. On the other hand, Co powder of a mean grain size of 1.0 μm and Ni powder of a mean grain size of 1.1 μm, both being commercially available, were used as the material of the bonding phase. Commercially available materials shown in Table 1 were used as the material of the fine hard grains for dispersion-strengthening of the bonding phase. These materials are TiCN, zirconium nitride (expressed as "ZrN"), HfC, $Al_2O_3$, $Y_2O_3$, $Dy_3O_2$, $ZrO_2$ and $Nd_3O_2$. These materials were crushed and sieved to grains of a mean grain size not greater than 0.3 μm. For the purpose of comparison, there were also prepared alloys which lack the above-mentioned fine grains and which alloys have $Ni_3TiAl$ precipitated in the bonding phase. Al was added to the comparison alloys in amount of 0.5 wt % so as to allow generation of precipitated fine grains.

The materials were mixed so as to provide a composition expressed by 45TiC-20WC-10NbC-5$Mo_2C$-8.5Co-8.5Ni-3 (fine hard grains), and the mixture was ball mill-crushed for 96 hours by wet mixing. After drying, the mixture powder was press-formed and sintered in vacuum for 1 hour at 1400° to 1550° C.

Figure 1:
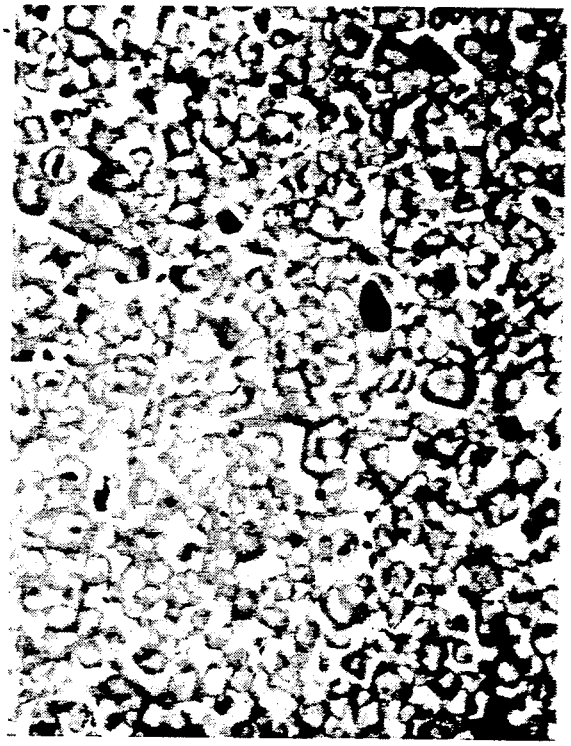
FIG. 1 is a photograph showing a representative micro structure of Example 1 of the cermet alloy of the invention.
Figure 7:
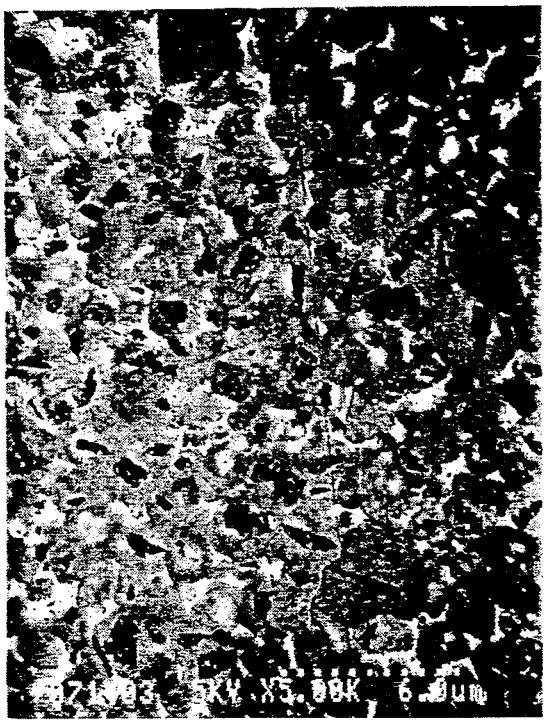
FIG. 7 is a photograph showing the metal structure of a conventional cermet alloy.

FIG. 1 is a photograph showing a representative metal structure of Example 1, as obtained through a scanning electron microscope as is the case of the photograph of FIG. 7. Referring to FIG. 1, the core structure of the composite carbo-nitride constituting the hard phase is white, while the surrounding structure is dark. An analysis of the hard phase through a transmission analyzing microscope showed that the core structure contained 38.6 wt % of Ti and 32.5 wt % of W, while the surrounding structure contained 60.3 wt % of Ti and 14.2 wt % of W.

Figure 2:
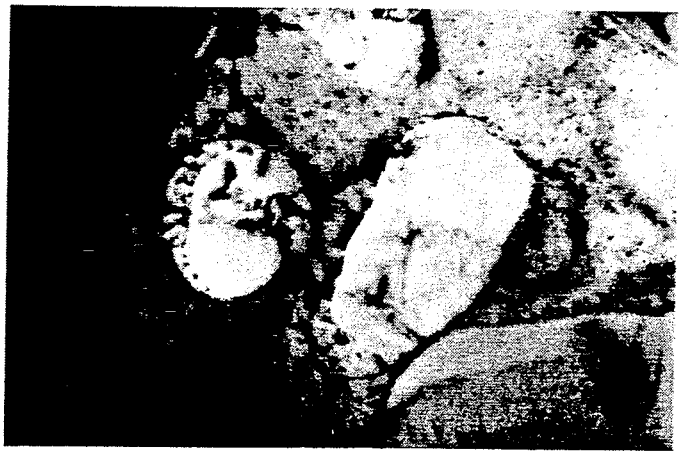
FIG. 2 is a photograph showing the micro structure around the fine hard grain in the Example 1.

FIG. 2 is a photograph showing the micro structure around the fine hard grains, as obtained through a transmission electron microscope. Grains having a spherical or cocoon shape are fine hard grains such as TiCN. These fine hard grains are dispersed in the bonding phase. Unlike the core structure or double core structure of the hard phase shown in FIG. 1, the fine hard grain permit existence of slight amounts of impurities. The fine hard grain, however, has a single layer structure without any core. Corners of the fine hard grains are partially dissolved into the bonding phase during sintering so that the grains exhibit spherical or cocoon-shaped forms after the sintering as shown in FIG. 2.

The sintered materials thus obtained were formed into SNGN 432-type tip (12.7 mm long, 12.7 mm wide and 4.76 mm thick). These tips were attached to a holder and subjected to test milling operation for the purpose of evaluation of the cutting performance. The evaluation was conducted by measuring the amount of plastic deformation of the tip edge, number of thermal cracks and amount of feed conducted before the breakage.

Figure 3:
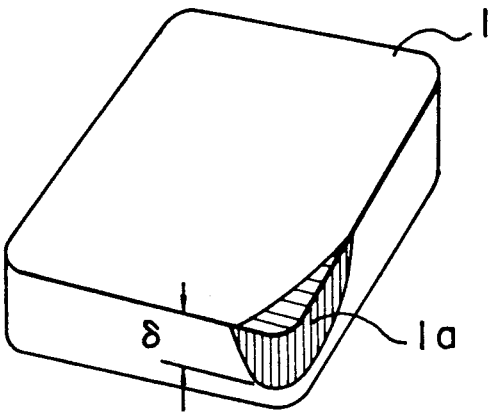
FIGS. 3 and 4 are perspective views schematically showing states of plastic deformation and thermal cracking occurring in edge portion of a tool.
Figure 4:
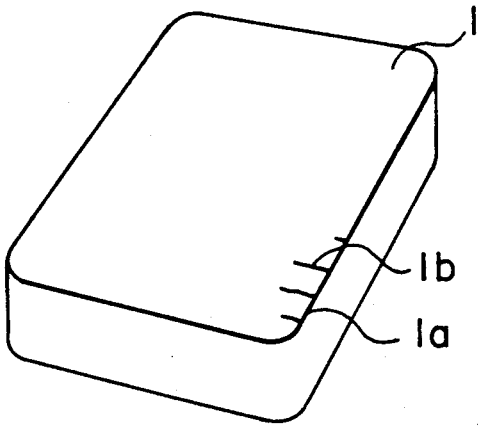

FIGS. 3 and 4 are perspective views schematically showing the states of plastic deformation and thermal crack occurring in the tip edge. Referring first to FIG. 3, a tip 1 has been formed in a substantially rectangular web-like form and attached to a holder (not shown) so as to be used in test cutting. As the cutting proceeds, the edge 1*a* of the tip is worn by a plastic deformation as illustrated by hatching. The amount of plastic deformation was evaluated in terms of the maximum depth δ of the plastically deformed portion. The test cutting was conducted by using a material SKD 61(Hs45) as the work, at a cutting speed of 200 m/min. cutting depth of 2 mm and a feed of 0.2 mm/tip. Referring now to FIG. 4, a thermal crack 1*b* substantially orthogonal to the ridge line of the tip 1 is generated in the tip edge 1*a* simultaneously with or independently of the above-mentioned plastic deformation, in the course of the cutting. In the milling machine, the work is cut intermittently so that heating and cooling are effected alternatingly and continuously so that the cutting tool is exposed to so-called heat cycle, resulting in occurrence of the thermal crack 1*b* as shown in FIG. 4. If such thermal crack occurs in plural and if such cracks are connected, the tip 1 will be broken. Thus, it is preferable for the cutting tool to have a small tendency of occurrence of thermal crack. The test cutting was conducted using a material SCM 440 (Hs 32) as the work, at a cutting speed of 150 m/min. depth of cut of 3 mm and a feed of 0.15 mm/tooth. The amount of feed until the breakage was measured by using a positive tip having a relief angle of 11°, using a material SKD 61 (Hs 30) as the work. The measurement was conducted ten times for each of two modes: namely, a cutting speed of 50 m/min and 200 m/min, at a depth of cut of 2 mm while increasing the feed at a rate of 0.05 mm/tooth, and the mean value of the values obtained through 10 measuring cycles was calculated and used as the criterion for the evaluation of the number of tips until breakage. The results of the test are shown in Table 1.

TABLE 1

| No. | Fine hard grain | Plastic deformation amount (mm) 10 sec | 20 sec | 30 sec | 60 sec | 90 sec | Number of thermal cracks 15 sec | 30 sec | 45 sec | 60 sec | 90 sec | Feed until breakage (mm/tip) 50 m/min | 200 m/min |
|---|---|---|---|---|---|---|---|---|---|---|---|---|---|
| Alloys of invention | | | | | | | | | | | | | |
| 1 | TiCN | 0.10 | 0.18 | 0.20 | 0.23 | 0.25 | 1 | 1 | 2 | 3 | 5 | 0.84 | 0.52 |
| 2 | Zrn | 0.06 | 0.09 | 0.12 | 0.15 | 0.18 | 1 | 2 | 4 | 5 | 7 | 0.77 | 0.68 |
| 3 | ZrCN | 0.06 | 0.10 | 0.15 | 0.17 | 0.20 | 2 | 2 | 4 | 6 | 9 | 0.75 | 0.65 |
| 4 | HfC | 0.07 | 0.09 | 0.14 | 0.18 | 0.22 | 1 | 2 | 4 | 6 | 8 | 0.70 | 0.59 |
| 5 | $Al_2O_3$ | 0.09 | 0.12 | 0.15 | 0.19 | 0.24 | 2 | 3 | 4 | 6 | 8 | 0.75 | 0.53 |
| 6 | $Y_2O_3$ | 0.07 | 0.11 | 0.15 | 0.16 | 0.19 | 2 | 2 | 3 | 5 | 8 | 0.88 | 0.55 |
| 7 | $Dy_3O_2$ | 0.11 | 0.14 | 0.19 | 0.25 | 0.28 | 1 | 2 | 3 | 5 | 9 | 0.90 | 0.61 |
| 8 | $Nd_3O_2$ | 0.05 | 0.09 | 0.13 | 0.16 | 0.18 | 1 | 2 | 4 | 6 | 9 | 0.95 | 0.70 |
| 9 | $ZrO_2$ | 0.07 | 0.10 | 0.14 | 0.16 | 0.20 | 1 | 2 | 3 | 5 | 6 | 0.75 | 0.62 |
| Comparison alloys | | | | | | | | | | | | | |
| 10 | None | 0.15 | 0.48 | broken | — | — | 7 | 14 | broken in 40 min | — | — | 0.75 | 0.21 |
| 11 | Precipitation Type $Ni_3TiAl$ | 0.10 | 0.15 | 0.17 | 0.20 | 0.24 | 3 | 5 | 8 | 12 | 15 | 0.45 | 0.55 |

As will be clearly understood from Table 1, the comparison alloy No. 10 exhibits a large plastic deformation at the tip edge and is broken after 30 second of use. This is attributable to the fact that the bonding phase has only a small strength due to the fact that no fine hard grains exist at all in the bonding phase. In addition, the comparison alloy No. 10 exhibited a very large number of thermal cracks and was broken after 40 seconds of use. The comparison alloy No. 11, in which the bonding phase is strengthened with precipitation type $Ni_3TiAl$ grains, exhibited a comparatively small amount of plastic deformation at the tip edge but the number of thermal cracks was large. The amount of feed until the breakage was comparatively small, particularly in low-speed cutting (50 m/min) which requires a specifically high mechanical strength. This seems to be attributable to the fact that the bonding phase has become too fragile as a result of precipitation of the $Ni_3TiAl$ grains in the bonding phase.

In contrast, the alloys Nos. 1 to 9 prepared in accordance with the present invention showed appreciably reduced thermal deformation and thermal cracks, as well as greater values of amount of feed until breakage. This is attributable to the fact that the plastic deformation-resistance is remarkably improved because the heat resistance of the bonding phase is improved due to presence of the fine hard grains in the bonding phase as well as the fact that the high temperature strength is improved as a result of suppression or prevention of mutual contact of the hard phase segments composed of composite carbo-nitrides.

EXAMPLE 2

Alloys having different surrounding structures of hard phase were prepared by using commercially available TiCN powder of a mean grain size of 1.4 μm, WC powder of a mean grain size of 1.2 μm, NbC powder of a mean grain size of 1.5 μm, $Mo_2C$ power of a mean grain size of 1.2 μm, Co powder of a mean grain size of 1.0 μm and Ni powder of a mean grain size of 1.1 μm. The alloy compositions were made to have 35TiCN-20WC-20NbC-15$Mo_2C$-5Ni-5Co. When it is desired to enrich the surrounding structure with WC, the Co and Ni were added after preparation of (Ti, Nb, Mo)CN. Namely, a solid solution material of (Ti, Nb, Mo)CN lacking the component with which the surrounding structure is to be enriched is produced by use of TiCN, NbC and $Mo_2C$ through the same method as Example 1 and then the powder of the enriching component is added alone to the solid solution powder material of (Ti, Nb, Mo) CN. In case of Ti, however, since the total amount of Ti is large, 15 wt % out of 35 wt % of Ti content was used to produce the solid solution material and the remainder 20 wt % was externally added independently. Then, a sintered alloys were produced in the same manner as Example 1. It was confirmed that these sintered member had a double core metal structure of the same type as that shown in FIG. 1. Alloy compositions, contents of the respective components in the core structure and the surrounding structure and physical values of the alloys are shown in Table 2.

TABLE 2

| No. | Alloy composition | | Contents (wt %) Ti | W | Nb | Mo | Physical value Hardness (Hv) | Transverse rupture strength (kgf/mm²) |
|---|---|---|---|---|---|---|---|---|
| | | | Core structure / Surrounding structure | | | | | |
| Alloys of invention | | | | | | | | |
| 12 | (Ti, W, Nb, Mo)CN + 20TiCN + | 5Co | 35 | 28 | 30 | 7 | 1510 | 170 |
| | | 5Ni | 60 | 15 | 11 | 14 | | |
| Comparison alloys | | | | | | | | |
| 13 | (Ti, Nb, Mo)CN + 20WC + | 5Co | 75 | 3 | 12 | 10 | 1515 | 165 |
| | | 5Ni | 21 | 45 | 18 | 16 | | |
| 14 | (Ti, W, Mo)CN + 20NbC + | 5Co | 62 | 26 | 3 | 9 | 1510 | 175 |

TABLE 2-continued

| No. | Alloy composition | | Contents (wt %) Ti | W | Nb | Mo | Physical value Hardness (Hv) | Transverse rupture strength (kgf/mm²) |
|---|---|---|---|---|---|---|---|---|
| | | | Core structure / Surrounding structure | | | | | |
| 15 | (Ti, W, Nb)CN + 15Mo₂C + | 5Ni | 29 | 17 | 39 | 15 | 1510 | 175 |
| | | 5Co | 50 | 25 | 22 | 3 | | |
| | | 5Ni | 31 | 22 | 19 | 28 | | |

It will be seen from Table 2 that, in comparison alloys No. 13 to 15, the core structures are rich in Ti and poor in W, whereas the surrounding structures are poor in Ti and rich in W. In contrast, in the alloy No. 12 prepared in accordance with the present invention, the core structure is poor in Ti and rich in W, while the surrounding structure was rich in Ti and poor in W. Thus, the Ti content in the surrounding structure is increased in the cermet alloy of the invention as compared with sample alloys.

The sintered alloys were formed into tips similar to that of Example 1, and these tips were attached to holders and subjected to a test turn-cutting for the purpose of evaluation of the wear resistance. The cutting was conducted by using a material SKD 61 (Hs 28) as the work, at a cutting speed of 250 m/min, depth of cut of 2 mm and feed of 0.15 mm/rev.

Figure 5:
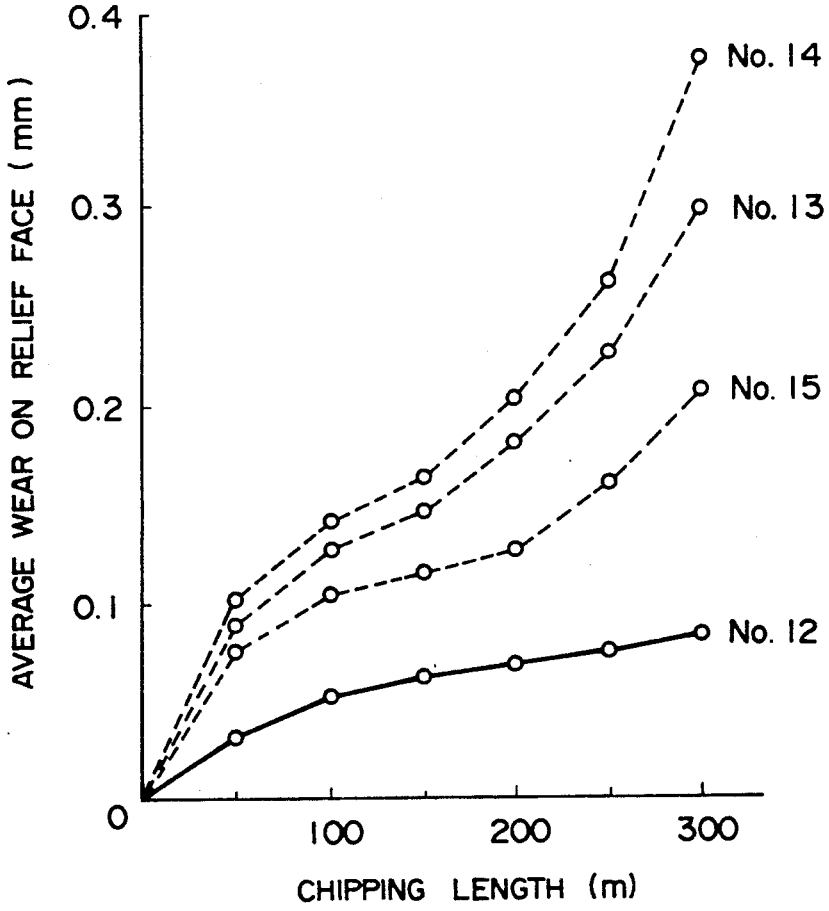
FIG. 5 is an illustration showing the relationship between the cutting length and the mean wear of relief surface.

FIG. 5 illustrates the relationship between the cutting length and the mean wear of the relief surface. Numerals attached to the respective curves in FIG. 5 correspond to the sample Nos, appearing in Table 2. Thus, the curve No. 12 shows the characteristic of the alloy of the present invention, while the curve Nos. 13 to 15 show characteristics of the comparison alloys. As will be seen from FIG. 5, in the comparison alloys Nos. 13 to 15, the wear rapidly proceeds immediately after the start of the cutting. The increment of the wear temporarily becomes small when the cutting length is around 100 mm but becomes large again as the cutting further proceeds. In particular, the wear increases quite rapidly when the cutting length is around 300 mm. In contrast, the alloy No. 12 in accordance with the present invention exhibits a substantially constant increment in accordance with the increase in the cutting length. The value of the mean wear of relief surface in the tip of the alloy No. 12 of the invention is remarkable small as compared with those of the comparison alloys Nos. 13 to 15. In particular, the wear at cutting length of 300 mm is about ¼ of that exhibited by the sample No. 14. Thus, the alloy No. 12 prepared in accordance with the invention exhibits very higher wear resistance than the comparison alloys Nos. 13 to 15, though the hardness levels are substantially equal. Such a large difference in the wear resistance is attributable to the difference in the compositions of the core structure and the surrounding structures of the hard phases between the alloy of the invention and the comparison alloys. Namely, in the comparison alloys Nos. 13 to 15, the Ti contents of the surrounding structures are smaller than those in the core structures, whereas, in the alloy No. 12 of the invention, the Ti content is higher in the surrounding structure than in the core structure, as will be seen from Table 2, and this is the reason why the alloy No. 12 prepared in accordance with the invention exibits very superior wear resistance.

EXAMPLE 3

Starting materials for forming the hard phase of the single layer structure was prepared by using at least one commercially available powder selected from the group consisting of TiC powder of a mean grain size of 1.4 μm, TiC powder of a mean grain size of 1.0 μm, TiN powder of a mean grain size of 1.3 μm, aluminum nitride (expressed as "AlN") powder of a mean grain size of 1.5 μm, vanadium carbide (expressed as "VC") powder of a mean grain size of 1.6 μm, vanadium nitride (expressed as "VN") powder of 1.3 μm, zirconium carbide (expressed as "ZrC") powder of a mean grain size of 2.0 μm, and ZrN powder of a mean grain size of 2.0 μm. Namely, these components were weighed to providge compositions as shown in Table 4 and each of these compositions was mixed by a wet-type ball mill for 48 hours, followed by 1-hour solid solution treatment at 2000° C. after drying. The solid solution treatment was conducted in a atmosphere having a nitrogen partial pressure of 200 Torr when the composition contained N, whereas, when N was not contained, the solid-solution treatment was executed in vacuum. The thus obtained powder was pulverized by a ball mill into grains having a mean grain size of 1.5 to 2.0 μm, and the grains were dried so as to be used as the starting material.

Alloys of compositions shown in Table 4 were prepared by using the thus prepared starting materials together with the hard phase formers, bonding phase formers nd the fine hard grain formers similar to those of Example 1, by the same alloy forming procedure as in Example 1.

Figure 6:
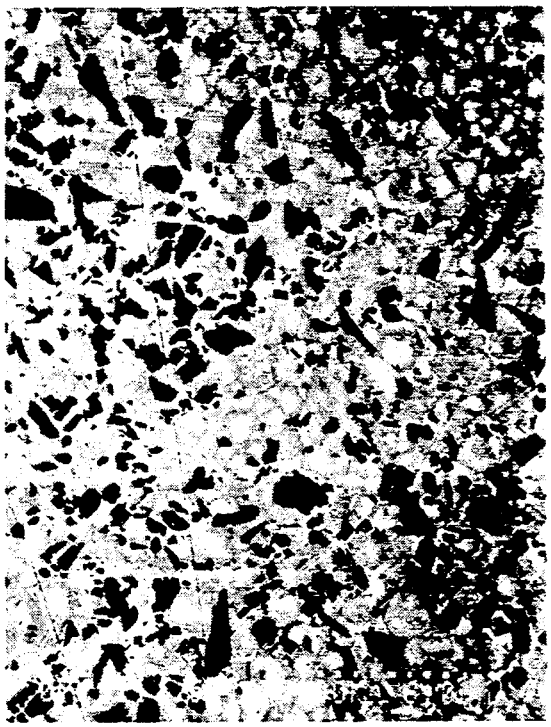
FIG. 6 is a photograph showing a representative metal structure of Example 3 of cermet alloy in accordance with the present invention.

FIG. 6 is a photograph showing the representative micro structures of Example 3, as obtained through a scanning electron microscope as in the case of Example 1. As will be seen from this Figure, an additional hard phase in black color is recognized besides the hard phase of the double core structure shown in FIG. 1. The hard phase of this black color is a carbide, nitride, carbo-nitride or their mixture containing TiCN or Ti. Unlike the hard phase having the aforementioned double core structure, this additional hard phase has a single layer structure, although it permits presence of slight amounts of impurities.

Tips were formed from the thus prepared alloys in the same manner as in the preceding Examples and were tested under the testing condition as shown in Table 3 for the purpose of evaluation of the cutting performance, the results being shown in Table 4.

TABLE 3

| Evaluation item | Cutting speed (m/min) | Depth of cut (mm) | Feed (mm/tooth) | Work (hardness Hs) |
|---|---|---|---|---|
| wear resistance | 200 | 2 | 0.15 | SKD61 (30) |
| plastic | 200 | 2 | 0.2 | SKD61 (45) |

TABLE 3-continued

| Evaluation item | Cutting speed (m/min) | Depth of cut (mm) | Feed (mm/tooth) | Work (hardness Hs) |
|---|---|---|---|---|
| deformation resistance | | | | |
| thermal cracking resistance | 150 | 3 | 0.15 | SCM440 (32) |
| breakage resistance | 50 | 2 | Var. | SKD61 (30) |
| | 200 | 2 | Var. | SKD61 (30) |

The thermal crack-resistance, however, was evaluated through a turning cutting so that the feed amount is shown in terms of mm/rev.

broken when the feed was incremented at a rate of 0.05 mm/tooth per 10 seconds.

As will be understood from Table 4, the comparison alloys Nos. 25 to 28 have no fine hard grains dispersed in their bonding phases nor any hard phase of single layer structure. These comparison alloys, therefore, are inferior in the wear resistance and in other items of cutting performance. In particular, the tips of Nos. 26 and 28 alloys were broken during the test. Comparison alloys Nos. 29 and 30,containing fine hard grains of $Ni_3Al(Ti)$ dispersed in their bonding phases, are still inferior in the thermal cracking resistance and breakage resistance, although the wear resistance is slightly improved. The comparison alloy No. 31, containing a hard phase of single layer structure of $(Ti_{0.5}Al_{0.5})N$ in excess

TABLE 4

| | Compositions (wt %) | | | | | | | | | | |
|---|---|---|---|---|---|---|---|---|---|---|---|
| | | | | | | | | | Hard phase of single layer structure | | Fine hard grain |
| No. | TiCN | WC | Nbc | TaC | $MO_2C$ | Co | Ni | Al | Components | Vol (%) | content |
| Alloys of invention | | | | | | | | | | | |
| 16 | 43 | 15 | 15 | — | 4 | 8 | 8 | — | TiCN | 17 | 7-TiCN |
| 17 | 40 | 15 | 15 | — | 4 | 8 | 8 | — | 8 $(Ti_{0.5}Al_{0.5})N$ | 15 | 2-$ZreO_2$ |
| 18 | 35 | 15 | 15 | — | 4 | 8 | 8 | — | 8 $(Ti_{0.5}Al_{0.5})CN$ | 14 | 7-TiCN |
| 19 | 40 | 15 | 10 | — | 9 | 8 | 8 | — | 8 $(Ti_{0.4}Al_{0.3}Zr_{0.3})N$ | 18 | 2-$Y_2O_3$ |
| 20 | 40 | 15 | 10 | — | 9 | 8 | 8 | — | 8 $(Ti_{0.4}Al_{0.3}V_{0.3})CN$ | 15 | 2-$Y_2O_3$ |
| 21 | 40 | 15 | 10 | — | 9 | 8 | 8 | — | 8 $(Ti_{0.5}Al_{0.5})C$ | 16 | 2-$ZrO_2$ |
| 22 | 47 | 15 | 15 | — | 4 | 8 | 8 | — | 1 $(Ti_{0.5}Al_{0.5})N$ | 2 | 2-$ZrO_2$ |
| 23 | 38 | 15 | 10 | — | 4 | 8 | 8 | — | 15 $(Ti_{0.5}Al_{0.5})N$ | 35 | 2-$ZrO_2$ |
| 24 | 40 | 15 | 15 | — | 6 | — | 14 | — | 8 $(Ti_{0.5}Zr_{0.5})CN$ | 15 | 2-$Y_2O_3$ |
| Comparison alloys | | | | | | | | | | | |
| 25 | 50 | 22 | 8 | — | 4 | 8 | 8 | — | — | 0 | — |
| 26 | 50 | 15 | — | 15 | 4 | 8 | 8 | — | — | 0 | — |
| 27 | 40 | 20 | 5 | — | 19 | 8 | 8 | — | — | 0 | — |
| 28 | 50 | 22 | 8 | — | 4 | — | 16 | — | — | 0 | — |
| 29 | 50 | 22 | 8 | — | 4 | 7.5 | 8 | 0.5 | — | 0 | $Ni_3Al(Ti)$ |
| 30 | 50 | 22 | 8 | — | 4 | 7 | 8 | 1 | — | 0 | $Ni_3Al(Ti)$ |
| 31 | 22 | 15 | 10 | — | 10 | 8 | 8 | — | 25$(Ti_{0.5}Al_{0.5})N$ | 48 | 2-$ZrO_2$ |

| | Cutting performance | | | | |
|---|---|---|---|---|---|
| | Wear resistance (mm) | Plastic deformation resistance (mm) | Thermal cracking resistance | Breakage resistance 50 m/min (mm/tip) | Breakage resistance 200 m/min (mm/tip) |
| Alloys of invention | | | | | |
| 16 | 0.22 | 0.15 | 5 | 0.85 | 0.68 |
| 17 | 0.18 | 0.11 | 6 | 0.90 | 0.71 |
| 18 | 0.16 | 0.12 | 5 | 0.95 | 0.77 |
| 19 | 0.20 | 0.11 | 4 | 0.85 | 0.63 |
| 20 | 0.22 | 0.165 | 5 | 0.98 | 0.78 |
| 21 | 0.25 | 0.14 | 6 | 0.91 | 0.70 |
| 22 | 0.31 | 0.23 | 3 | 0.73 | 0.53 |
| 23 | 0.11 | 0.09 | 7 | 0.90 | 0.77 |
| 24 | 0.14 | 0.15 | 5 | 0.88 | 0.60 |
| Comparison alloys | | | | | |
| 25 | 0.58 | 0.45 | 15 | 0.88 | 0.21 |
| 26 | 0.55 | broken | 12 | 0.90 | 0.19 |
| 27 | 0.50 | 0.58 | 15 | 0.91 | 0.28 |
| 28 | broken | 0.49 | 14 | 0.90 | 0.22 |
| 29 | 0.35 | 0.20 | 13 | 0.45 | 0.70 |
| 30 | 0.33 | 0.17 | 15 | 0.39 | 0.75 |
| 31 | 0.10 | 0.10 | 10 | 0.50 | 0.77 |

In Table 4, the "wear" in the item of cutting performance represents the mean wear of the relief surface as measured after 30-minute cutting operation, while "plastic deformation resistance" shows the amount of plastic deformation (see FIG. 3) as measured after 30-second cutting operation. The "thermal cracking resistance" shows the number of thermal cracks (see FIG. 4) as observed on the tip edge after 60-minute cutting operation. The "breakage resistance" shows the amount of feed (mean value of 10 cases) made before the tip is of 40 vol %, are still inferior in thermal cracking resistance and in the breakage resistance, though it exhibits superior wear resistance and plastic deformation resistance. In contrast, the alloy Nos. 16 to 24 of the invention show excellent cutting performance. This is attributable to the fact that the bonding phase is dispersion-strengthened by the fine hard grains dispersed therein and that the additional hard phase of single layer structure exists in addition to the hard phase of the double core structure.

EXAMPLE 4

Alloys having different C contents were prepared by the same process as Example 3 to have compositions as shown in Table 5. The alloys having higher C contents were prepared by addition of C powder, while the alloys of lower C contents were prepared by replacing a portion of TiCN by TiN. The C content indication in Table 5 is shown by dividing into ten equal parts the C content range of the sound phase and then by counting the C content from the lower end part of the C content toward the upper end part thereof. As explained before, the term "C content range of sound phase" means the range of C content between an upper limit more than which precipitation of free C starts to appear and the lower limit of the same less than which decarburization layer starts to appear.

The sintered alloys thus prepared were formed into tips similar to those of Example 1 and were subjected to cutting operation tests conducted under the same conditions as Example 1 for the purpose of evaluation of the cutting performance, thus obtaining results as shown in Table 5.

As will be clearly seen from Table 5, the comparison alloys Nos. 41 and 42, which lack both of the fine hard grains and the additional single layer hard phase and in which the C content is set at the upper limit of the sound phase range, exhibit considerably large amounts of plastic deformation. The reason is that the solid-solutioning of the heat-resistant metallic elements such as W, Mo and so forth into the bonding phase is small due to small lattice constant of the bonding phase, so that the solid solution strengthening function in the bonding phase is insufficient to thereby make plastic deformation resistance small at high temperature. Tips made of these comparison alloys, therefore, were broken during cutting and exhibited small thermal cracking resistance. Comparison alloy Nos. 43 and 44 were strengthened by dispersion of $Y_2O_3$ in the bonding phase. Although the wear resistance is slightly improved, thermal cracking resistance is not so high because the C content is set at a level near the upper limit of the sound phase range. Comparison alloys Nos. 39 and 40 exhibit slight improvement in the cutting performance as compared with preceding comparison alloys, by virtue of strengthening of the bonding phase by dispersion of TiCN and also by the presence of the additional hard phase of single layer structure. In these alloys, however, the C contents are set at levels near the upper limit of the sound phase, so that the solid solution strengthening of the bonding phase is insufficient to thereby make level of thermal cracking resistance small. In contrast, the alloys Nos. 32 to 38 prepared in accordance with the present invention show extremely small amounts of plastic deformation and very small numbers of thermal cracks, thus proving much superior plastic deformation resistance and thermal cracking resistance. In these alloys Nos. 32 to 38, the C content is determined to be ½ or less of the sound phase range from the lower limit of the sound phase range, so that the bonding phases have large lattice constant values with the result that the solid-solutioning of heat-resistant metallic elements such as W, Mo and so forth into the bonding phase is increased to produce solid solution strengthening effect on the bonding phase. The superior plastic deformation resistance and thermal cracking resistance are attributable to this fact. It is clear that the solid solution strengthening of the bonding phase is further enhanced to further improve the plastic deformation resistance and thermal cracking resistance when the C content is selected to fall within ½ of the sound phase range from the lower limit thereof.

TABLE 5

| | Compositions | | | | | | | | | | |
|---|---|---|---|---|---|---|---|---|---|---|---|
| No. | TiCN | WC | Nbc | $MO_2C$ | VC | Co | Ni | $N_2$ | Fine hard grain | Single layer structure | C-content range |
| Alloys of invention | | | | | | | | | | | |
| 32 | 48 | 15 | 15 | 4 | 2 | 8 | 8 | 3.3 | TiCN | TiCN | 1/10 |
| 33 | " | " | " | " | " | " | " | 3.0 | " | " | 3/10 |
| 34 | " | " | " | " | " | " | " | 2.8 | " | " | 5/10 |
| 35 | 46 | 15 | 15 | 4 | 2 | 8 | 8 | 3.4 | 2-$Y_2O_3$ | — | 1/10 |
| 36 | " | " | " | " | " | " | " | 3.2 | " | — | 4/10 |
| 37 | 40 | 15 | 15 | 4 | 2 | 8 | 8 | 3.3 | TiCN | 8 $\left(\begin{matrix}Ti_{0.5}\\Al_{0.5}\end{matrix}\right)$ N | 1/10 |
| 38 | " | " | " | " | " | " | " | 3.1 | " | " | 4/10 |
| Comparison alloys | | | | | | | | | | | |
| 39 | 48 | 15 | 15 | 4 | 2 | 8 | 8 | 2.6 | " | TiCN | 6/10 |
| 40 | " | " | " | " | " | " | " | 2.4 | " | — | 9/10 |
| 41 | 50 | 20 | 8 | 4 | 2 | 8 | 8 | 2.9 | — | — | 6/10 |
| 42 | " | " | " | " | " | " | " | 2.4 | — | — | 9/10 |
| 43 | 46 | 15 | 15 | 4 | 2 | 8 | 8 | 3.0 | 2-$Y_2O_3$ | — | 7/10 |
| 44 | " | " | " | " | " | " | " | 2.8 | " | — | 10/10 |

| | Cutting performance | | | | | | | | |
|---|---|---|---|---|---|---|---|---|---|
| | Plastic deformation amount | | | | | Number of thermal cracks | | | |
| | 20 sec | 40 sec | 60 sec | 90 sec | 120 sec | 15 min | 30 min | 45 min | 90 min |
| Alloys of invention | | | | | | | | | |
| 32 | 0.04 | 0.05 | 0.06 | 0.08 | 0.09 | 0 | 1 | 2 | 3 |
| 33 | 0.05 | 0.08 | 0.10 | 0.11 | 0.15 | 1 | 2 | 4 | 5 |
| 34 | 0.09 | 0.11 | 0.15 | 0.17 | 0.21 | 2 | 3 | 3 | 5 |
| 35 | 0.05 | 0.06 | 0.08 | 0.10 | 0.11 | 0 | 1 | 2 | 4 |
| 36 | 0.11 | 0.15 | 0.19 | 0.21 | 0.23 | 2 | 3 | 5 | 6 |
| 37 | 0.03 | 0.04 | 0.05 | 0.06 | 0.08 | 0 | 0 | 2 | 3 |
| 38 | 0.08 | 0.10 | 0.14 | 0.16 | 0.18 | 1 | 2 | 4 | 6 |
| Comparison alloys | | | | | | | | | |
| 39 | 0.12 | 0.16 | 0.20 | 0.24 | 0.28 | 4 | 6 | 6 | 8 |

TABLE 5-continued

| | | | | | | | | | |
|---|---|---|---|---|---|---|---|---|---|
| 40 | 0.15 | 0.20 | 0.26 | 0.32 | 0.38 | 4 | 6 | 7 | 10 |
| 41 | 0.21 | 0.29 | 0.46 | broken | — | 7 | 10 | 12 | 16 |
| 42 | 0.42 | broken | — | — | — | 9 | 14 | 18 | broken |
| 43 | 0.12 | 0.19 | 0.23 | 0.23 | 0.30 | 4 | 7 | 8 | 9 |
| 44 | 0.16 | 0.28 | 0.32 | 0.32 | 0.40 | 3 | 8 | 10 | 12 |

EXAMPLE 5

Alloys of compositions shown in Table 6 were prepared by making use of the same commercially available powders as those used in Example 1, through the same alloying process as Example 1. Tips formed from the thus obtained sintered alloys were subjected to the same test as Example 3 for the purpose of evaluation of the cutting performance. The results of the test are shown in Table 6.

TABLE 6

| | Compositions | | | | | | | | | | Cutting performance | | | | |
|---|---|---|---|---|---|---|---|---|---|---|---|---|---|---|---|
| | | | | | | | | | | Fine | Wear | Plastic deformation | Thermal cracking | Breakage resistance | |
| No. | TiCN | WC | Nbc | Tac | $MO_2C$ | VC | ZrC | Co | Ni | hard grain | resistance | resistance | resistance | 50 m/min | 200 m/min |
| Alloy of invention | | | | | | | | | | | | | | | |
| 45 | 53.8 | 8 | 15 | — | 7 | 2 | 0.2 | 7 | 7 | TiCN | 0.32 | 0.20 | 4 | 0.95 | 0.77 |
| 46 | 46.8 | 15 | 15 | — | 7 | 2 | 0.2 | 7 | 7 | TiCN | 0.35 | 0.25 | 3 | 0.90 | 0.70 |
| 47 | 36.8 | 25 | 15 | — | 7 | 2 | 0.2 | 7 | 7 | TiCN | 0.39 | 0.30 | 3 | 0.98 | 0.60 |
| 48 | 53.8 | 8 | — | 15 | 7 | 2 | 0.2 | 7 | 7 | TiCN | 0.40 | 0.28 | 3 | 0.89 | 0.65 |
| 49 | 46.8 | 15 | 10 | 5 | 7 | 2 | 0.2 | 7 | 7 | TiCN | 0.38 | 0.26 | 4 | 0.91 | 0.68 |
| 50 | 53.8 | 15 | 8 | — | 7 | 2 | 0.2 | 7 | 7 | TiCN | 0.30 | 0.19 | 4 | 0.90 | 0.75 |
| 51 | 46.8 | 15 | 15 | — | 7 | 2 | 0.2 | 7 | 7 | TiCN | 0.35 | 0.25 | 5 | 0.80 | 0.70 |
| 52 | 36.8 | 15 | 25 | — | 7 | 2 | 0.2 | 7 | 7 | TiCN | 0.39 | 0.29 | 4 | 0.88 | 0.70 |
| 53 | 43.8 | 15 | 13 | — | 10 | 2 | 0.2 | 7 | 7 | 2-$Y_2O_3$ | 0.30 | 0.28 | 3 | 0.98 | 0.71 |
| 54 | 51.8 | 15 | 13 | — | 2 | 2 | 0.2 | 7 | 7 | 2-$Y_2O_3$ | 0.29 | 0.20 | 5 | 0.79 | 0.70 |
| 55 | 52.8 | 10 | 15 | — | 7 | 1 | 0.2 | 7 | 7 | TiCN | 0.40 | 0.32 | 5 | 0.95 | 0.65 |
| 56 | 48.8 | 10 | 15 | — | 7 | 5 | 0.2 | 7 | 7 | TiCN | 0.21 | 0.18 | 6 | 0.75 | 0.74 |
| 57 | 55.9 | 10 | 10 | — | 7 | 3 | 0.1 | 7 | 7 | TiCN | 0.33 | 0.35 | 4 | 0.95 | 0.68 |
| 58 | 54.5 | 10 | 10 | — | 7 | 3 | 1.5 | 7 | 7 | TiCN | 0.30 | 0.22 | 5 | 0.88 | 0.65 |
| 59 | 51.0 | 27 | 10 | — | 7 | 3 | 3.0 | 7 | 7 | 2-$Y_2O_3$ | 0.28 | 0.15 | 6 | 0.75 | 0.71 |
| 60 | 20 | 22 | 25 | — | 10 | 3 | 1.0 | 7 | 7 | 2-$ZrO_2$ | 9.42 | 0.32 | 2 | 0.90 | 0.65 |
| 61 | 30 | 10 | 20 | — | 10 | 3 | 1.0 | 7 | 7 | 2-$ZrO_2$ | 0.40 | 0.30 | 3 | 0.85 | 0.68 |
| 62 | 60 | 4 | 8 | — | 5 | 2 | 1.0 | 7 | 7 | 2-$Y_2O_3$ | 0.15 | 0.15 | 6 | 0.70 | 0.78 |
| 63 | 57.8 | 4 | 15 | — | 5 | 2 | 0.2 | 7 | 7 | 2-$Y_2O_3$ | 0.35 | 0.29 | 6 | 0.51 | 0.70 |
| 64 | 31.8 | 32 | 15 | — | 5 | 2 | 0.2 | 7 | 7 | 2-$Y_2O_3$ | 0.65 | broken | 5 | 0.95 | 0.50 |
| 65 | 31.8 | 32 | 13 | — | 5 | 2 | 0.2 | 7 | 7 | 2-$Y_2O_3$ | 0.50 | 0.50 | 4 | 0.95 | 0.50 |
| 66 | 58.8 | 15 | 3 | — | 5 | 2 | 0.2 | 7 | 7 | TiCN | 0.55 | 0.48 | 5 | 0.95 | 0.52 |
| 67 | 28.8 | 15 | 33 | — | 5 | 2 | 0.2 | 7 | 7 | TiCN | 0.66 | 0.58 | 5 | 0.42 | 0.48 |
| 68 | 34.8 | 20 | 15 | — | 12 | 2 | 0.2 | 7 | 7 | 2-$Y_2O_3$ | 0.68 | 0.45 | 5 | 0.95 | 0.49 |
| 69 | 46.8 | 20 | 15 | — | — | 2 | 0.2 | 7 | 7 | 2-$Y_2O_3$ | 0.39 | 0.30 | 5 | 0.50 | 0.68 |
| 70 | 53.8 | 10 | 15 | — | 7 | — | 0.2 | 7 | 7 | TiCN | 0.51 | 0.35 | 5 | 0.90 | 0.54 |
| 71 | 46.8 | 10 | 15 | — | 7 | 7 | 0.2 | 7 | 7 | TiCN | 0.18 | 0.15 | 5 | 0.45 | 0.71 |
| 72 | 56.0 | 10 | 10 | — | 7 | 3 | — | 7 | 7 | TiCN | 0.35 | 0.45 | 6 | 0.85 | 0.55 |
| 73 | 50.0 | 10 | 10 | — | 7 | 3 | 4 | 7 | 7 | 2-$Y_2O_3$ | 0.24 | 0.13 | 6 | 0.40 | 0.69 |
| 74 | 5 | 22 | 43 | — | 9 | 3 | 2 | 7 | 7 | 2-$Y_2O_3$ | broken | broken | 10 | 0.51 | 0.41 |
| 75 | 74.8 | 2 | 2 | — | 5 | 2 | 0.2 | 7 | 7 | TiCN | 0.15 | 0.20 | 15 | 0.35 | 0.58 |

As will be seen from Table 6, a comparison alloy No. 63 exhibits rather inferior toughness and inferior high temperature strength due to small WC content. Thermal cracking resistance is also inferior and breakage resistance is seriously small particularly in low-speed cutting which requires a high mechanical strength. Comparison alloys Nos. 64 and 65, which have excessively large WC contents, show inferior toughness due to increase in the amount of surrounding structure of the hard phase comprising composite carbo-nitride. In particular, wear resistance, plastic deformation resistance and breakage resistance in high-speed cutting are seriously reduced. A comparison alloy No. 66 shows a low level of high temperature strength due to a small NbC content. This alloy, therefore, is inferior in wear resistance, plastic deformation resistance and breakage resistance in high-speed cutting. On the other hand, a comparison alloy No. 67 exhibits a reduced toughness and, hence, extremely inferior cutting performance due to increase in the amount of formation of the surrounding structure caused by a large NbC content, as is the case where the WC content is excessively large. A comparison alloy No. 68 exhibits generally inferior cutting performance in all aspects except the breakage resistance at low cutting speed. Namely, the hardness is reduced due to excessively large $Mo_2C$ content, with the result that the high temperature wear resistance is reduced. A comparison alloy No. 69 exhibit a serious reduction in the breakage resistance. This is attributable to the fact that the toughness is decreased due to insufficient wettability between the hard phase and the bonding phase because of lack of $Mo_2C$ in the composition. Comparison alloy No. 70 exhibits extremely inferior wear resistance and inferior breakage resistance at high cutting speed, as a result of lack of VC which can bring about improvement in the high-temperature strength. A comparison alloy No. 71 exhibits inferior breakage resistance due to a reduction of mechanical strength caused by an excessively large VC content. Comparison alloy No. 72 exhibits serious reduction in both the plastic deformation resistance and breakage resistance at high speed. This is attributable to insufficient improvement in the high temperature strength and toughness due to lack of ZrC. A comparison alloy No. 73 suffers from reduction in the exhibits inferior wear resistance and breakage in low-speed cutting due to excessively large ZrC content. A comparison alloy No. 74 is inferior in all aspects of the cutting performance. The tip made from this alloy was broken during cutting. This alloy cannot have high temperature wear resistance and high temperature strength due to shortage of the TiCN which is a hard phase former. In addition, a large NbC content causes an increase in the amount of formation of the surrounding structure rather than improvement in the high temperature strength, so that the toughness is reduced. The inferior performance of the comparison alloy No. 74 is attributed to these facts. A comparison alloy sample No. 75 exhibits inferior thermal cracking resistance and breakage resistance in low-speed cutting, partly because of a reduction in the toughness due to excessively large TiCN content and partly because of the small content of NbC.

In contrast to these comparison alloys, the alloys Nos. 45 to 62 prepared in accordance with the present invention exhibit much superior cutting performance because the contents of the respective components fall within appropriate ranges.

EXAMPLE 6

Alloys were prepared by the same process as in Example 4 while varying N contents. Table 7 shows the $N_2$ content (wt %) and the results of evaluation of cutting performance. The $N_2$ content was adjusted by using TiCN having C/N ratios of 7/3, 5/5 and 3/7, respectively. The alloys were made to have such composition as 45TiCN-15WC-15NbC-7$Mo_2C$-2VC-1ZrC-7.5Co-7.5Ni. Both the hard phase of the single layer structure and the fine hard grains were formed from TiCN.

TABLE 7

| | | Cutting performance | | | | |
|---|---|---|---|---|---|---|
| | | | | | Breakage resistance | |
| No. | $N_2$ | Wear resistance | Plastic deformation resistance | Thermal cracking resistance | 50 m/min | 200 m/min |
| Alloys of invention | | | | | | |
| 76 | 3.0 | 0.35 | 0.25 | 5 | 0.88 | 0.68 |
| 77 | 3.9 | 0.34 | 0.25 | 5 | 0.90 | 0.65 |
| 78 | 4.2 | 0.28 | 0.21 | 4 | 0.79 | 0.71 |
| 79 | 4.9 | 0.25 | 0.20 | 5 | 0.75 | 0.75 |
| 80 | 5.5 | 0.20 | 0.15 | 3 | 0.70 | 0.78 |
| 81 | 7.0 | 0.15 | 0.11 | 3 | 0.68 | 0.80 |
| Comparison alloys | | | | | | |

TABLE 7-continued

| | | Cutting performance | | | | |
|---|---|---|---|---|---|---|
| | | | | | Breakage resistance | |
| No. | $N_2$ | Wear resistance | Plastic deformation resistance | Thermal cracking resistance | 50 m/min | 200 m/min |
| 82 | 2.0 | 0.52 | 0.49 | 7 | 0.85 | 0.41 |
| 83 | 1.0 | 0.61 | 0.55 | 7 | 0.91 | 0.22 |

As will be seen from Table 7, the comparison alloys Nos. 82 and 83 exhibit serious degradation in wear resistance, plastic deformation resistance and breakage resistance in high-speed cutting. This is attributable to insufficient solid solution strengthening of the bonding phase due to little solid-solutioning of heat-resistant metallic elements such as W an Mo into the bonding phase, which little solid-solutioning occurred due to a small lattice constant of the bonding phase caused by a small $N_2$ content.

On the other hand, alloys Nos. 76 to 81 exhibit remarkably improved cutting performance because the bonding phases in these alloys have been sufficiently strengthened by solid-solutioning of the heat-resistant metallic elements into the bonding phases by virtue of large $N_2$ contents.

EXAMPLE 7

Alloys having different levels of coercive force were prepared as shown in Table 8 by varying the C content as in the case of Example 4. Tips similar to those of Example 1 having been formed from these alloys were subjected to a cutting test conducted under the same conditions as Example 1 for the purpose of evaluation of cutting performance. The results are shown in Table 8.

TABLE 8

| | Compositions | | | | | | | | | | | Cutting performance | | | | | | |
|---|---|---|---|---|---|---|---|---|---|---|---|---|---|---|---|---|---|---|
| | | | | | | | | | | | | Plastic deformation amount | | | | Number of thermal cracks | | |
| No. | TiCN | WC | Nbc | $MO_2C$ | VC | Co | Ni | $N_2$ | Fine hard grain | Hard grain of single layer | Coercive force | 20 sec | 60 sec | 90 sec | 120 sec | 30 min | 45 min | 90 min |
| Alloys of invention | | | | | | | | | | | | | | | | | | |
| 84 | 48 | 15 | 15 | 4 | 2 | — | 16 | 4.5 | TiCN | TiCN | 0 | 0.05 | 0.08 | 0.10 | 0.13 | 0 | 2 | 3 |
| 85 | 48 | 15 | 15 | 4 | 2 | 6 | 10 | 4.4 | " | " | 0 | 0.04 | 0.07 | 0.10 | 0.13 | 0 | 2 | 3 |
| 86 | 48 | 15 | 15 | 4 | 2 | 8 | 8 | 4.5 | " | " | 20 | 0.04 | 0.06 | 0.09 | 0.11 | 1 | 2 | 4 |
| 87 | 48 | 15 | 15 | 4 | 2 | 11 | 5 | 4.4 | " | " | 40 | 0.04 | 0.05 | 0.06 | 0.09 | 2 | 3 | 5 |
| Comparison alloys | | | | | | | | | | | | | | | | | | |
| 88 | 48 | 15 | 15 | 4 | 2 | — | 16 | 4.0 | " | " | 88 | 0.51 | broken | — | — | 4 | 8 | 9 |
| 89 | 48 | 15 | 15 | 4 | 2 | 6 | 10 | 3.9 | " | " | 110 | 0.21 | 0.48 | broken | — | 6 | 8 | 10 |
| 90 | 48 | 15 | 15 | 4 | 2 | 8 | 8 | 4.2 | " | " | 130 | 0.15 | 0.29 | 0.38 | 0.49 | 6 | 10 | 14 |
| 91 | 48 | 15 | 15 | 4 | 2 | 11 | 5 | 4.2 | " | " | 155 | 0.14 | 0.22 | 0.29 | 0.39 | 9 | 15 | broken |

From Table 8, it will be understood that, while comparison alloys Nos. 88 to 91 show large amounts of plastic deformation and large numbers of thermal cracks, alloys Nos. 84 to 87 exhibit remarkably reduced tendency of plastic deformation and thermal cracking, thus proving a long service life. The level of the coercive force varies depending on the C content. In the alloys of the invention, the C content is determined to be ½ or less of the sound phase from the lower limit of the sound phase, so that the coercive force is generally small. In consequence, the results shown in Table 8 are similar to these shown in Table 5.

Figure 8:
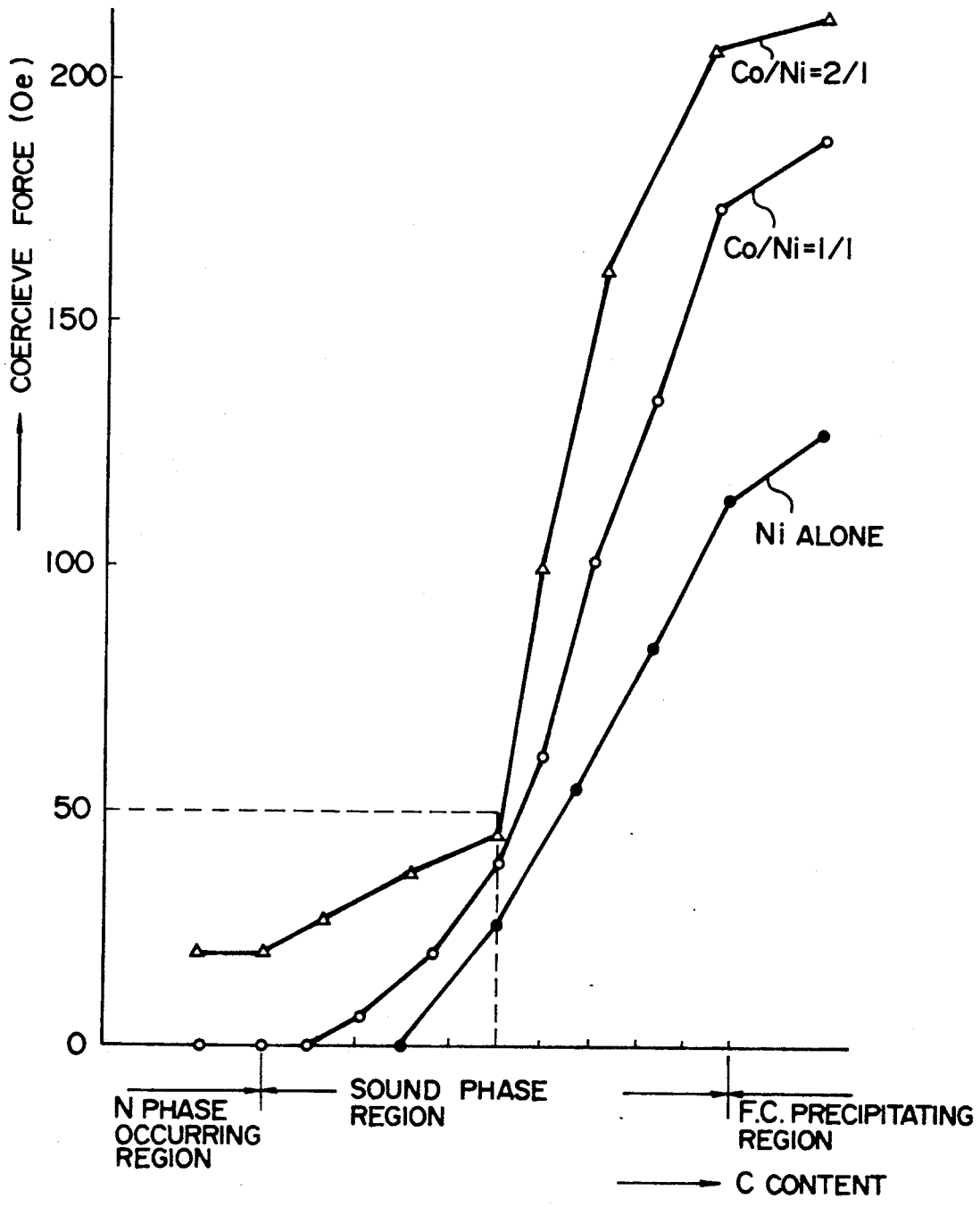
FIG. 8 is a chart showing the relationship between the C content of a cermet alloy and coercive force.

FIG. 8 is a diagram showing the relationship between the C content of the alloy and the coercive force. The greater the Co content, the greater the coercive force, where the C content is constant. As will be seen from FIG. 8, the coercive force can be reduced to a level below 50 Oe, by setting the ratio Ni/(Co+Ni) to be 3/10 or greater, when the C content is above the lower limit of the sound phase range and below ½ of the sound phase range, whereby superior cutting performance is obtainable.

The cermet alloy of the present invention having the described features offers the following advantages.

(1) Plastic deformation resistance is remarkably improved by virtue of multiplied effect: namely, strengthening of the bonding phase by fine hard grains dispersed in the bonding phase and solid solution strengthening of the bonding phase by solid-solutioning of heat-resistant metallic elements.

(2) Fine hard grains.dispersed in the bonding phase prevent any contact or bonding between hard phase grains despite any growth of the hard phase grains due to increase in the surrounding structure, whereby the toughness and thermal cracking resistance are remarkably increased.

(3) A remarkable improvement in wear resistance is obtainable when the hard phase has a double core structure composed of a core structure comparatively poor in Ti and rich in W and a surrounding structure comparatively rich in Ti and poor in W.

(4) A further improvement in wear resistance is possible by dispersing an additional hard phase of a singe layer structure.

(5) The lattice constant of the bonding phase can be increased by suitably controlling the C and/or N content, so that the solid solution strengthening effect on the bonding phase is further enhanced.

(6) These advantages enables a cermet alloy to be used as a material of cutting tools for machining hard materials, including end mill tools, and offer a long service life of such tools even in high-speed cutting.

What is claimed is:

1. A cermet alloy having a structure including a hard phase and a bonding phase which is comprised of at least one of iron group metals of the periodic table, said bonding phase containing fine hard grains of a mean grain size not greater than 2000 Å dispersed therein; wherein said fine hard grains are made up of at least one grain selected from the group consisting of ZrN, ZrCN, HfC, $Al_2O_3$, $Y_2O_3$, $Dy_2O_3$, $ZrO_2$ and $Nd_2O_3$.

2. A cermet alloy according to claim 1, having a coercive force not greater than 50 Oe.

3. A cermet alloy according to claim 1, wherein the ratio Ni/(Co+Ni) is not smaller than 3/10.

* * * * *